US009039949B2

(12) United States Patent
Iwabuchi et al.

(10) Patent No.: US 9,039,949 B2
(45) Date of Patent: May 26, 2015

(54) METHOD OF MOLDING GAS HYDRATE PELLET

(75) Inventors: Wataru Iwabuchi, Chiba (JP); Tomoaki Egami, Chiba (JP); Hideo Narita, Hokkaido (JP); Jiro Nagao, Hokkaido (JP); Kiyofumi Suzuki, Hokkaido (JP)

(73) Assignees: Mitsui Engineering and Shipbuilding Co., Ltd, Tokyo (JP); National Institute of Advanced Industrial Science and Technology, Tokyo (JP)

( * ) Notice: Subject to any disclaimer, the term of this patent is extended or adjusted under 35 U.S.C. 154(b) by 0 days.

(21) Appl. No.: 14/114,728

(22) PCT Filed: Mar. 19, 2012

(86) PCT No.: PCT/JP2012/056957
§ 371 (c)(1),
(2), (4) Date: Mar. 6, 2014

(87) PCT Pub. No.: WO2012/132980
PCT Pub. Date: Oct. 4, 2012

(65) Prior Publication Data

US 2014/0203471 A1 Jul. 24, 2014

(30) Foreign Application Priority Data

Mar. 30, 2011 (JP) ..... 2011-073903

(51) Int. Cl.
*C10L 3/10* (2006.01)
*C10L 5/08* (2006.01)
(Continued)

(52) U.S. Cl.
CPC . *C10L 5/08* (2013.01); *B30B 9/067* (2013.01); *C10L 3/108* (2013.01); *C10L 2290/58* (2013.01); *C10L 2290/46* (2013.01); *C10L 2290/32* (2013.01); *C10L 5/363* (2013.01)

(58) Field of Classification Search
None
See application file for complete search history.

(56) References Cited

U.S. PATENT DOCUMENTS 8,096,798 B2 * 1/2012 Watanabe et al. ..... 425/77
2005/0107648 A1 * 5/2005 Kimura et al. ..... 585/15
(Continued)

FOREIGN PATENT DOCUMENTS

JP 4-53703 A 2/1992
JP 2007-270029 A 10/2007
(Continued)

OTHER PUBLICATIONS

Machine translation of JP 2010-235868.*
(Continued)

*Primary Examiner* — Mary F Theisen
(74) *Attorney, Agent, or Firm* — Andrus Intellectual Property Law, LLP

(57) ABSTRACT

A method is for molding a gas hydrate pellet for improving convenience of handling of a natural gas hydrate during transportation and storage, and thereby improving the practical use of the natural gas hydrate. Gas hydrate slurry is fed in a compression chamber, and pressure and compression are applied to the gas hydrate slurry by advancing a compression plunger. At that time, a stroking speed of the compression plunger is set minimum, preferably less than a value expressed by a stroke length of the compression plunger at compression$\times 10^{-2}$ (m/min. By advancing the compression plunger at low speed, binding between particles of the gas hydrate is tightened, thereby the gas hydrate pellet with increased shearing strength can be molded.

2 Claims, 5 Drawing Sheets

(51) Int. Cl.
*B30B 9/06* (2006.01)
*C10L 5/36* (2006.01)

(56) References Cited

U.S. PATENT DOCUMENTS

| | | | | |
|---|---|---|---|---|
| 2009/0247797 | A1* | 10/2009 | Katoh et al. | 585/15 |
| 2010/0244292 | A1* | 9/2010 | Iwasaki et al. | 264/6 |
| 2010/0326132 | A1* | 12/2010 | Murayama et al. | 62/611 |

FOREIGN PATENT DOCUMENTS

| | | | |
|---|---|---|---|
| JP | 2009-221458 | A | 10/2009 |
| JP | 2009-241039 | A | 10/2009 |
| JP | 2009-242727 | A | 10/2009 |
| JP | 2010-235868 | A | 10/2010 |

OTHER PUBLICATIONS

International Search Report for parent application PCT/JP2012/056957, having a mailing date of Jul. 17, 2012.

* cited by examiner (a)

(b)

Prior Art

METHOD OF MOLDING GAS HYDRATE PELLET

CROSS-REFERENCE TO RELATED APPLICATIONS

This application is the U.S. national stage application of International Application No. PCT/JP2012/056957, filed Mar. 19, 2012, which International application was published on Oct. 4, 2012 as International Publication No. WO 2012/132980 A1 in the Japanese language and which application is incorporated herein by reference. The International application claims priority of Japanese Patent Application No. 2011-073903, filed Mar. 30, 2011, which application is incorporated herein by reference.

TECHNICAL FIELD

In a gas hydrate formation plant, natural gas hydrate such as existing under the seabed or the like is generated and produced into gas hydrate pellets suitable for transportation, storage, and so on. The present invention relates to a method of molding the gas hydrate pellets with high strength in the gas hydrate formation plant.

BACKGROUND ART

Natural gas hydrate (NCH) that is composed mostly of methane exists under the seabed not greater than 500 m deep surrounding the continent and in the frozen areas such as Siberia, Canada and Alaska. The NGH is water solid substance or clathrate hydrate of which primary components are gas molecules of methane and others and water molecules, this water solid substance or clathrate hydrate is stable at low temperature under high pressure. The NGH draws attention as clean energy with low emission of carbon dioxide and air pollutant.

In general, natural gas is liquefied, and then stored to be used as energy. The liquefied natural gas is produced and stored at extremely-low temperature of −162° C. On the contrary, the natural gas hydrate has the advantage of exhibiting stable properties without decomposition and being handled as a solid at temperature of −20° C., and so on. Since the natural gas hydrate has such properties, a natural gas hydrate method (NGH method) involving formation, transportation, storage and regasification of natural gas is expected as means of effective use of gas resources in small- and medium-scale gas fields all over the world which have not been developed due to profitability reasons, or in such a case that a small lot is transported a short distance from a large-scale gas field.

In the NGH method, NGH is formed in a format suitable for transportation and storage at a NGH shipping site such as a small- or medium-scale gas field, and the NGH is transported to a NGH receiving site as designated by a vessel, vehicle or the like. At the NGH receiving site, the transported NGH is stored and used by gasification in a gasification apparatus as energy source when needed. FIG. 5 is a schematic view for explaining an example of a structure of the plant which is used at the NGH shipping site for forming a gas hydrate. A mined raw material gas G is hydrated by being mixed fully with water W in a generator 1 that is a high-pressure reaction vessel, thereby a low-density gas hydrate (GH) slurry is generated. The generated GH slurry is fed in a dewaterer 3 by a feed pump 2, then dewatered, and thereby a high-density GH slurry is obtained. At that time, the GH slurry is fed into a bottom of the dewaterer 3. The fed GH slurry goes upward in the dewaterer 3. The GH slurry is dewatered while going upward at a draining portion (a portion provided with micropores, slits or the like for separating hydrate particles from water) which is provided on a mid-position its way up in the dewaterer 3, and is taken out of an upper end portion of the dewaterer 3. The gas hydrate taken out is in the form of GH cake. The GH cake is fed in a pellet molding apparatus 4 for pelletization, and molded into pellets having a size suitable for transportation, storage or the like. Subsequently, the GH pellet is cooled by a cooler 5 to such a temperature at which the GH pellet does not decompose under ambient pressure, and then fed in a depressurizer 6. The process steps for the gas hydrate from the generator 1 before the cooler 5 is performed at room temperature under high pressure which is the condition for forming the gas hydrate. Then, the gas hydrate is processed to such a temperature that the gas hydrate does not decompose under ambient pressure in the cooler 5 and the depressurizer 6. After that, the molded GH pellets are fed to and stored in a storage tank.

By the way, the applicant of the present application proposes the method and the apparatus for producing gas hydrate pellets, allowing for production of gas hydrate pellets excellent in storability at low cost (refer to Patent Document 1). According to the method for producing gas hydrate pellets, a gas hydrate is dewatered by compression and molding means under the condition of forming the gas hydrate so that a gas hydrate is generated with raw material gas between the gas hydrate particles and water, and thereby a gas hydrate pellet is produced. And, as the compression and molding means, used is a briquetting machine comprising a pair of rollers rotating in opposite directions and each having an outer peripheral surface provided with a plurality of molds for pellets.

Further, the applicant of the present application proposed an apparatus for molding gas hydrate pellets to improve the efficiency in molding the GH pellets by performing a dewatering process and a molding process of the GH pellets by using a single device in a gas hydrate formation plant (refer to Patent Document 2). In the apparatus for molding gas hydrate pellets according to Patent Document 2, a compression plunger is arranged in an inner cylinder of a compression chamber, water is squeezed out from GH slurry which is fed into the inner cylinder by advancing the compression plunger, and the water is drained through a screening portion provided in a part of the inner cylinder. After the water is squeezed out, a gate valve is opened, the GH pellet P is pushed and moved into a cooling chamber through the gate valve by further advancing the plunger. Then, the gate valve, is closed, the cooling chamber is cooled, and following GH slurry is fed subsequent to retreat of the compression plunger.

PRIOR ART DOCUMENTS

Patent Documents

Patent Document 1: JP-A, 2007-270029; Patent Document 2: JP-A, 2010-235868

SUMMARY OF INVENTION

Problem to be Solved by the Invention

The inventors of the present invention repeated shearing tests on GH pellets molded from generated GH for the purpose of obtaining data contributing to project and design of an apparatus for molding the GH pellets. Here, considering efficiency in operation of a GH formation plant, the molding rate of the GH pellets was increased by increasing a stroking speed of the compression plunger, thus the processing rate was increased. For this reason, specimens for shearing tests are molded with the stroking speed of the compression plunger being increased.

However, when the specimens of the GH pellets obtained in the above molding manner were placed in a triaxial compression test apparatus for the shearing test and the shearing test was conducted, the specimens were broken just under a slight axial load stress, and accurate measurements were not obtained. Then, after trial and error in various studies, the GH pellets with enhanced strength have been successfully formed, and as a result, almost accurate shearing stress has been able to be measured. That is, strength of the GH pellets generated and molded in the GH formation plant can be increased.

Then, it is an object of the present invention to provide a method of molding GH pellets with increased shearing strength, for facilitating handling of the GH pellets during transportation and storage.

Means for Solving Problem

Now provided is technical means to accomplish the foregoing object, which is derived from a method for testing shearing strength of gas hydrate pellets according to the present invention. According to the present invention, there is provided a method of molding a gas hydrate pellet in a gas hydrate formation plant including a generator in which a raw material gas and water are fed and adapted for reacting the raw material gas with water under high pressure in the venerator to produce a gas hydrate slurry and removing water from the gas hydrate slurry that is produced to mold the gas hydrate slurry into a gas hydrate pellet of desired size. The method comprises the steps of feeding the gas hydrate slurry in a cylindrical compression chamber provided with a compression plunger capable of advancing and retreating in the cylindrical compression chamber in a direction of an axis of the compression chamber, and advancing the compression plunger to exert compression action for squeezing out water from the gas hydrate slurry to mold the gas hydrate pellet. An advancing speed of the compression plunger is set minimum.

According to the present invention, a compression speed of the compression plunger is reduced as low as possible. On the other hand, a retreating speed of the compression plunger may be set high.

When the GH pellet is molded by applying compression at high compression speed, compression action of the compression plunger is completed before binding between GH particles is tightened. This is considered a possible reason why GH pellets with low shearing strength were molded.

On the other hand, when the GH pellet is molded by applying compression at low compression speed, compression pressure is applied until binding between the GH particles is tightened. This is considered a reason why GH pellets have high shearing strength.

In the method of molding a gas hydrate pellet according to claim 2, the advancing speed of the compression plunger is set less than the value expressed by:

$$\text{Length of the pellet before compression} \times 10^{-2} \text{(m/min)}$$

When the compression plunger moves in a predetermined length for compressing the gas hydrate slurry, the GH pellet is molded from the GH slurry fed in the compression chamber. A size of the GH pellet to be molded depends on a specification of the compression chamber. However, the GH pellet is preferably molded with high density regardless of the size of the compression chamber. Further, since the density of the GH slurry fed is almost constant, the percentage of water squeezed out from the GH slurry in the process of squeezing out water is constant regardless of the size of the compression chamber. For this reason, the binding between the GH particles is tightened regardless of the size or the like of the compressing chamber, by squeezing out water by advancing the compression plunger at low speed. The advancing speed of the compression plunger at that time is set less than the value expressed by;

$$\text{Length of a pellet before compression} \times 10^{-2} \text{ (m/min)}$$

Effects of the Invention

According to the method of molding GH pellets according to the present invention, the GH pellets may be molded with high shearing strength by tight binding between GH particles. Thus, it is possible to provide the GH which is very convenient for handling during transport and storage.

MODE FOR CARRYING OUT THE INVENTION

Figure 1:
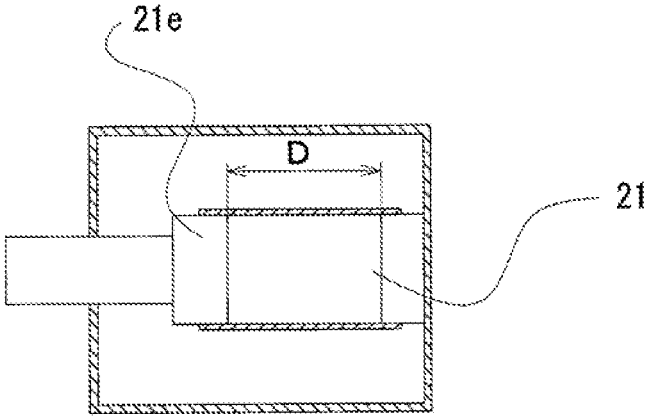
FIG. 1 is a view schematically showing a structure of a compression chamber and a compression plunger for explaining a method of molding a GH pellet according to the present invention.
Figure 1:
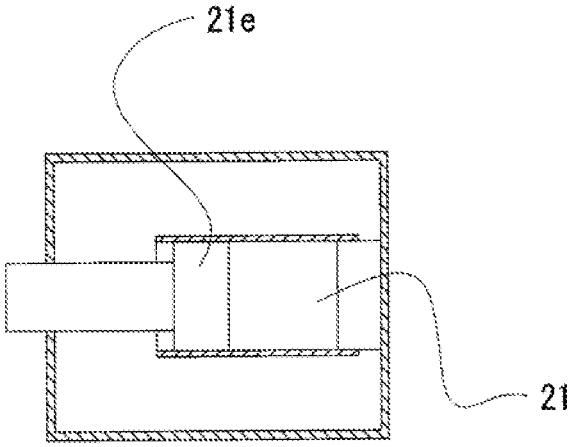

Hereinafter, a method of molding a gas hydrate pellet according to the present invention will be concretely described based on the preferred embodiments as illustrated in the drawings.

Figure 4:
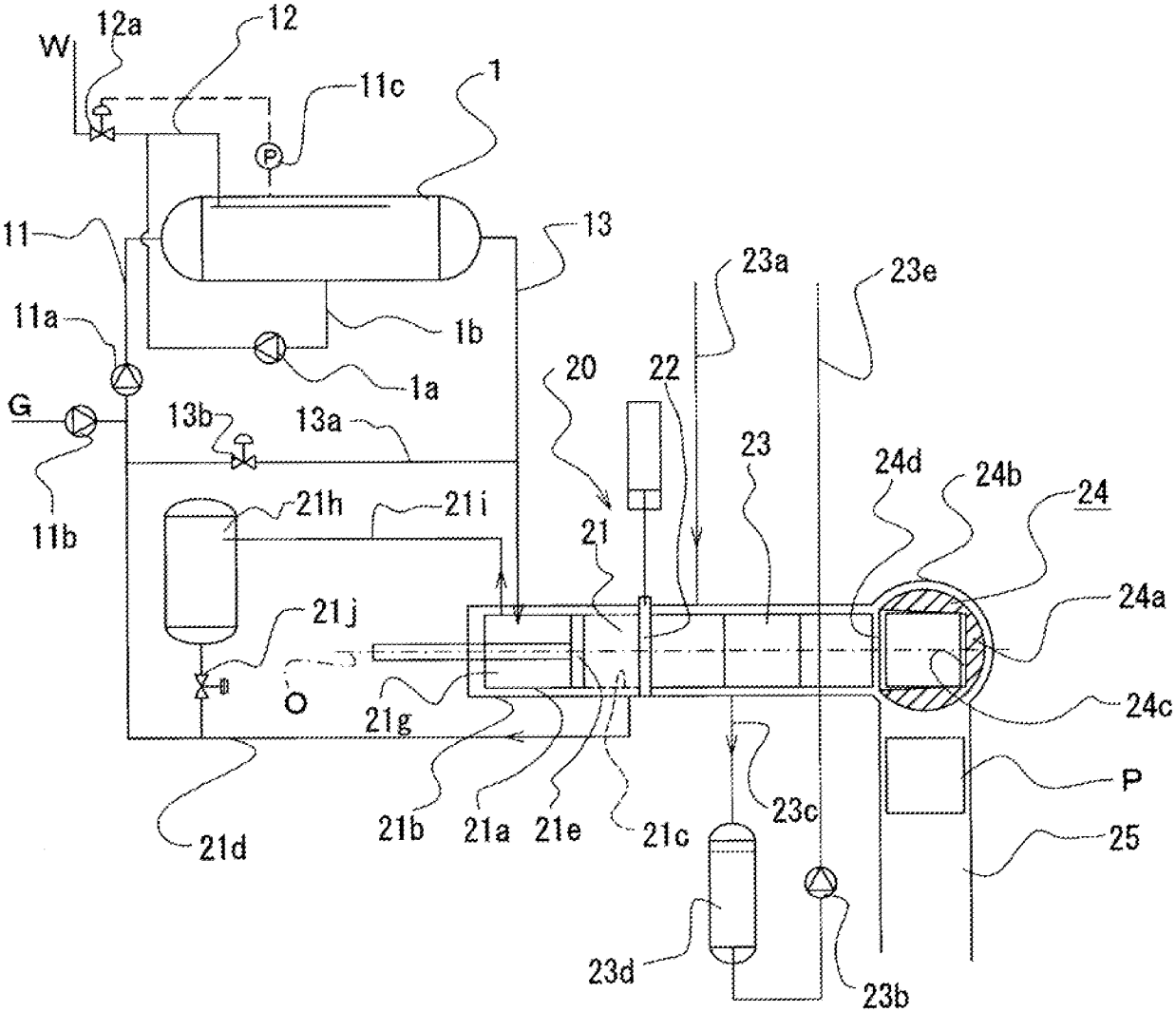
FIG. 4 is an explanatory view showing an example of a GH formation plant, and illustrating the example of the GH formation plant suitable for practicing the method of molding a GH pellet according to the present invention.
Figure 5:
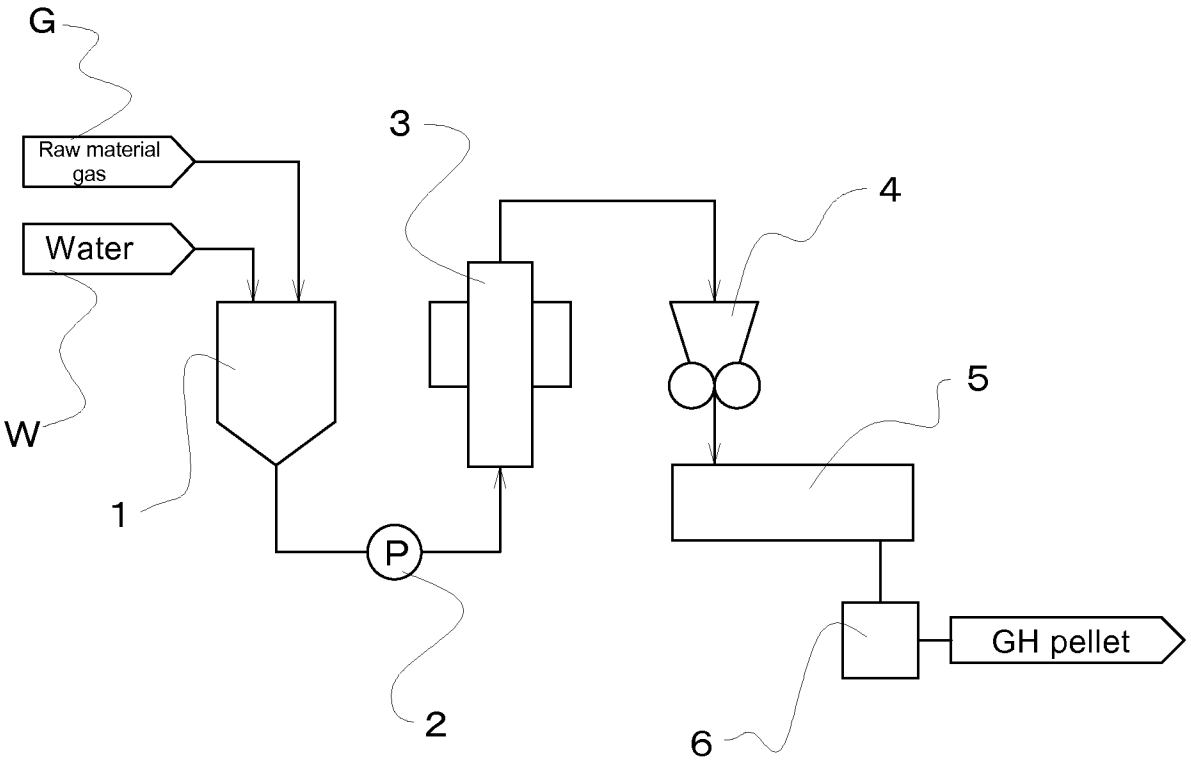
FIG. 5 is a block diagram for explaining an example of a structure of a conventional GH formation plant which is applied at a natural GH shipping site.

In FIG. 4, an apparatus for molding GUI pellets comprising a compression chamber and a compression plunger and adapted for practicing the invention.

In a GH formation plant, a raw material gas G and water W are fed in the generator 1 via a raw material feed pipe 11 and a refrigerant feed pipe 12, respectively. GH slurry is generated by reacting the raw material gas G and the water W in the generator 1, then the GH slurry is fed in a compression chamber 21 of a pellet molding apparatus 20 via a slurry feed pipe 13. On the other hand, an unreacted refrigerant is recovered from the generator 1 by a refrigerant recirculation pump 1*a* via a return pipe 1*b*. A discharge end of the refrigerant recirculation pump 1*a* is connected to the refrigerant feed pipe 12. The refrigerant feed pipe 12 is provided with a regulation valve 12*a*, and a valve opening of the regulation valve 12*a* is regulated based on measurement values of a pressure gauge 11*c* which measures an internal pressure of the generator 1.

The compression chamber 21 comprises an inner cylinder 21*a* of cylindrical shape and an outer cylinder 21*b* which accommodates the inner cylinder 21*a*. The inner cylinder 21*a* accommodates a compression plunger 21*e* capable of advancing and retreating slidingly in a direction of an axis O of the inner cylinder 21*a*. The compression plunger 21*e* advances and retreats by operation of a not-shown drive source. A hydraulically drive source, a motor drive source with a rack-pinion mechanism which converts an output power of a motor into a linear motion, or the like may be used as the drive source. A part of the inner cylinder 21*a* defines a screening part 21*c* which is provided with perforations of suitable size.

The compression chamber 21 is communicated with a cooling chamber 23 is a gate valve 22, at an advanced end position of the compression plunger 21*e*. Opening the gate valve 22 allows communication between the compression chamber 21 and the cooling chamber 23. The cooling chamber 23 is in the form of a cylinder having an inner diameter equal to or greater than that of the inner cylinder 21*a* of the compression chamber 21.

The cooling chamber 23 is provided with a pellet transfer valve 24, at an end opposite from the compression chamber 21. The pellet transfer valve 24 comprises a valve casing 24*b* accommodating a spherical valve element 24*a*, like a so-called ball valve. The valve element 24*a* includes a holding chamber 24*c*. The holding chamber 24*c* is sized with an inner diameter equal to or greater than that of the cooling chamber 23 and a depth sufficient to accommodate a GH pellet. A part of the holding chamber 24*c* is open and defines an opening 24*d*. The opening 24*d* is designed to be located at a receiving position facing the cooling chamber 23, and at a discharge position facing a feed path 25 for feeding the GH pellet to a dewatering process in response to turning of the valve element 24*a* relative to the valve casing 24*b*. When the feed path 25 communicates with a following depressurizing process, an internal pressure thereof is ambient pressure, therefore, the cooling chamber 23 is not allowed to communicate with the feed path 25 by rotating action of the valve element 24*a*. For example, the valve element 24*a* is adapted to be positioned at the discharge portion by turning from the receiving position as shown in FIG. 4 in a clockwise direction, and to be positioned at the receiving position by turning from the discharge position in an anti-clockwise direction.

A lower portion of the compression chamber 21 is connected to a slurry recovery pipe 21*d*. A slurry circulation pump 11*a* is connected at a suction end to the slurry recovery pipe 21*d*, and at a discharge end to the raw material feed pipe 11. Further, the slurry circulation pump 11*a* is connected also at the suction end to a discharge end of the raw material feed pump 11*b*. That is to say, water squeezed out during process of the GH slurry in the compression chamber 21 joins with the raw material fed by the raw material feed pump 11*b*, and is returned in the generator 1 by the slurry circulation pump 11*a*. The slurry feed pipe 13 is connected at a mid-position along its length to the slurry recovery pipe 21*d* by way of a return pipe 13*a*. The return pipe 13*a* is provided with a return valve 13*b* at as mid-position along its length. A gas/water buffer 21*h* is connected via a back-pressure pipe 21*i* to a back-pressure chamber 21*g* which is located opposite from the compression chamber 21 with respect to the compression plunger 21*e*. The gas/water buffer 21*h* is connected to the slurry recovery pipe 21*d* via a regulation valve 21*j*.

In the cooling chamber 23, a high-pressure cooling medium is fed via a refrigerant feed pipe 23*a*, and the cooling medium is recovered via a refrigerant recovery pipe 23*c* by a recovery pump 23*b*. Meanwhile, the refrigerant recovery pipe 23*c* is provided with a refrigerant buff 23*d* which is adapted to stabilize operation of the recovery pump 23*b* by transiently storing the refrigerant recovered. A discharge pipe 23*b* which is connected to the recovery pump 23*c* at a discharge end of the recovery pump 23*b*, is connected to a not-shown refrigerant source such as a cooler to which the refrigerant feed pipe 23*a* is also connected, whereby a cooling medium which is fed in the cooling chamber 23 from the refrigerant source is recovered.

For molding a GH pellet, first, the compression plunger 21*e* is located at a backmost retreated position, namely, at a position most away from the cooling chamber 23, the gate valve 22 is closed, and the valve element 24*a* of the pellet transfer valve 24 is located at the receiving position. At that time, the inner cylinder 21*a* of the compression chamber 21 is fed with GH slurry, and charged with a predetermined amount of the GH slurry.

For example, when a 10-weight percent GH slurry is fed in the inner cylinder 21*a*, the plunger 21*e* advances, thereby the GH slurry in the compression chamber 21 is compressed and thus squeezed out water to a 90-weight percent GH in the form of a GH pellet P. The water squeezed out here flows out through the screening portion 21*c* into the outer cylinder 21*b* and is recovered via the slurry recovery pipe 21*d* by the slurry circulation pump 11*a*, and is returned into the generator 1.

FIG. 1 (*a*) shows that the compression plunger 21*e* is located at a back position with the GH slurry being fed in the compression chamber 21. Subsequent to this state the compression plunger 21*e* is advanced and the GH slurry fed in the compression chamber 21 is squeezed out water. At that time, the advancing speed, namely the compression speed of the compression plunger 21*e* is minimized. Where D (m) represents a length of the compression chamber 21 as shown in FIG. 1 (*a*), the compression speed $V_p$, is preferably given by the following.

$$V_p < D \times 10^{-2} \text{ (m/min)} \quad \text{(Equation 1)}$$

When the GH pellet is molded, the gate valve 22 is opened to communicate the compression chamber 21 with the cooling chamber 23. The compression chamber 21 has the same internal pressure as the cooling chamber 23 and the holding chamber 24*c*, since the pellet transfer valve 24 is located at the receiving position with respect to the feed path 25. The compression plunger 21*e* continues to advance to a position of the gate valve 22, and the 90-weight-percent GH in the form of the pellet to which water is squeezed out is pushed out of the compression chamber 21 and fed in the cooling chamber 23. By the way, in the case that the cooling chamber 23 is occupied by a GH pellet which has been molded in a precedent cycle, the GH pellet P in the same quantity as the GH pellet to be fed in the cooling chamber 23 is pushed out of the cooling chamber 23 into the holding chamber 24*c* when the compression plunger 21*e* reaches the fully advanced end position. When the GH pellet is pushed out of the compression chamber 21 by advancing the compression plunger 21*e*, the gate valve 22 is closed.

The gate valve 22 is closed, the compression plunger 21*e* begins to retreat, and the GH slurry is fed in the inner cylinder 21*a*. Since the cooling chamber 23 is made airtight when the gate valve 22 is closed, the GH pellet in the cooling chamber 23 is cooled to such a temperature that the GH pellet is kept stable even under ambient pressure, by feeding the refrigerant through the refrigerant feed pipe 23*a* in the cooling chamber 23.

At retreat of the compression plunger 21*a* to the backmost end position, the valve element 24*a* is turned from the receiving position to the discharge position. At that time, an end portion of the cooling chamber 23 is kept closed with the valve element 24*a* by turning the valve element 24*a* in the clockwise direction. While the valve element 24*a* is located at the discharge position, the GH pellet P is depressurized, and the GH pellet P received in the holding chamber 24*c* falls in the feed path 25. Subsequently, the valve element 24*a* is returned to the receiving position by turning the valve element 24*a* from the discharge position in the anti-clockwise direction, in FIG. 4. Then, a series of the process by the apparatus for molding a GH pellet is completed.

By repeating the above operation, the GH pellets may be produced successively, and the GH pellets molded in this manner may have increased strength.

Figure 2:
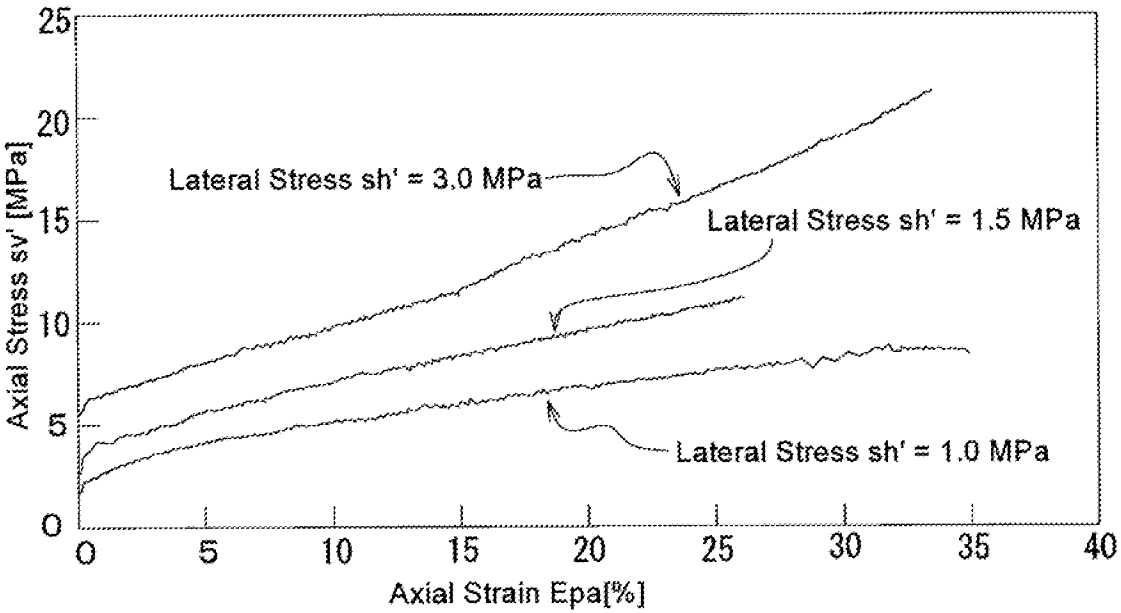
FIG. 2 is a view showing a result of a strength test conducted with regard to a GH pellet molded in a method of molding a GH pellet according to the present invention. In the method, a speed of the compression plunger is equal to a value expressed by an initial length $L_0$ of a GH pellet$\times 10^{-4}$ (m/min.). In the test, each lateral stress sh' of 1.0, 1.5, and 3.0 (MPa) is applied.
Figure 3:
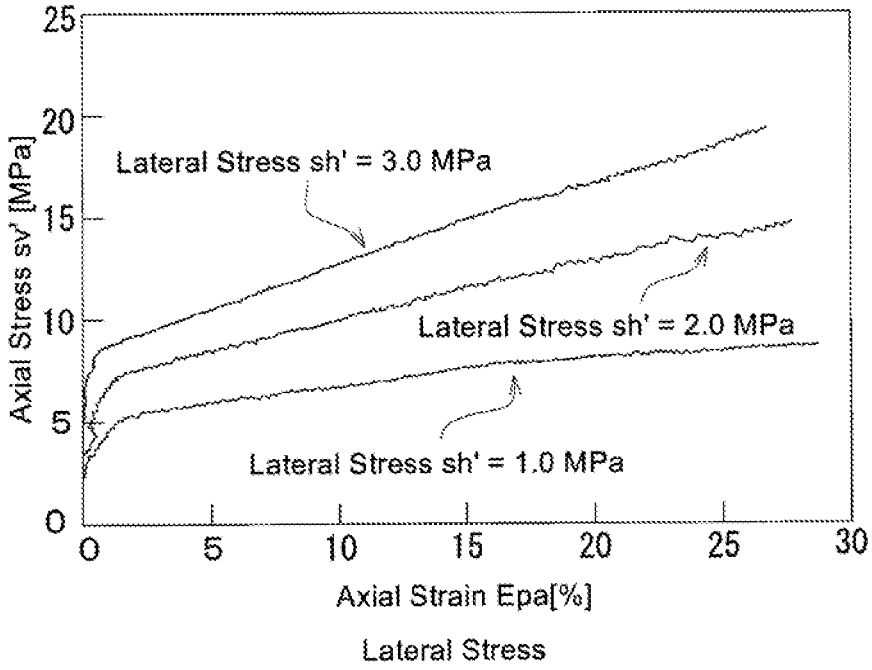
FIG. 3 is a view showing a result of a strength test conducted with regard to a GH pellet molded in a method of molding a GH pellet according to the present invention. In the method, a speed of a compression plunger is equal to a value expressed by an initial length $L_0$ of a GH pellet$\times 10^{-3}$ (m/min.). In the test, each lateral stress sh' of 1.0, 2.0, and 3.0 (MPa) is applied.

FIGS. 2 and 3 show the relationship between the axial stress sv' (MPa) and the axial strain Epa (%) as the results of the tests performed in regard to strength of GH pellets produced by the molding method according to the present invention, by using a triaxial compression test apparatus. The test is performed by placing the GH pellets obtained by using the apparatus for molding GH pellets as shown in FIG. 4, in the triaxial compression test apparatus. The triaxial compression test is adapted for the GH only in the solid state. The results of the tests are equivalent to the results based on repeated compressions in the compression chamber 21 as shown in FIG. 4. For shearing testing, an axial stress (stress in the vertical direction) relative to a predetermined lateral stress (stress in the horizontal direction) sh' is applied to specimens in the triaxial test apparatus. In the test shown in FIG. 2, the lateral stresses sh' are 1.0, 1.5 and 3.0 (MPa), respectively, and the length D of a stroke of the compression plunger represents the initial length $L_0$ of the GH pellet. The axial strain Epa given by the Equation 2 is obtained with increasing the axial stress sv'. The speed of a plunger for applying the axial stress sv' is according to the above Equation 1, and equal to the initial length $L_0$ of GH pellet$\times 10^{-4}$ (m/min).

$$\text{Axial Strain Epa}(\%)=((L_0-L)/L_0)\times 100 \quad \text{(Equation 2)}$$

L represents the length of GH pellet at the time.

FIG. 3 shows the result of the test where the lateral stresses sh' are 1.0, 2.0 and 3.0 (MPa), respectively and the advancing speed of the compression plunger is equal to the initial length $L_0$ of the GH pellet$\times 10^{-3}$ (m/min).

As shown in FIGS. 2 and 3, the larger the axial strain Epa, the more the axial stress sv' is increased. We can determine that in either of the conditions, the strength of the pellet is increased by compression. That is, we can determine that the strength of a GH pellet is increased by molding the GH pellet under compression applied to the GH by advancing the compression plunger at low speed. For performing the strength test, the GH pellet is molded so as to be suitable to be placed in the triaxial compression test apparatus, and is used as specimen for the strength test. In the GH formation plant, GH pellets are molded by compressing GH slurry by advancing a compression plunger at the lowest speed.

INDUSTRIAL APPLICABILITY

According to the method of molding GH pellets of the present invention, the GH pellets with high strength can be molded, therefore, easiness of handling of GH pellets during transportation and storage is optimized, and the method of molding GH pellets of the present invention can make a contribution to improved utility value of GH as energy.

EXPLANATION OF THE REFERENCE NUMERALS

1 Generator
20 Pellet molding apparatus
21 Compression chamber
21*a* Inner cylinder
21*b* Outer cylinder
21*e* Compression plunger
22 Gate valve
23 Cooling chamber
25 Feed path

The invention claimed is:

1. A method of molding a gas hydrate pellet in a gas hydrate formation plant including a generator in which a raw material gas and water are fed and adapted for reacting the raw material gas with water under high pressure in the generator to produce a gas hydrate slurry and removing water from the gas hydrate slurry that is produced to mold the gas hydrate shiny into a gas hydrate pellet of desired size, the method, comprising:

feeding the gas hydrate slurry in a cylindrical compression chamber provided with a compression plunger capable of advancing and retreating in the cylindrical compression chamber in a direction of an axis of the compression chamber, advancing the compression plunger to exert compression action for squeezing out water from the gas hydrate slurry to mold the gas hydrate pellet, and minimizing an advancing speed of the compression plunger at a time when water is squeezed from the gas hydrate slurry so that binding between particles of a gas hydrate is tightened and the molded gas hydrate pellet has an increased shearing strength.

2. A method of molding a gas hydrate pellet in a gas hydrate formation plant including a generator in which a raw material gas and water are fed and adapted for reacting the raw material gas with water under high pressure in the generator to produce a gas hydrate slurry and removing water from the gas hydrate slurry that is produced to mold the gas hydrate slurry into a gas hydrate pellet of desired size, the method, comprising:

feeding the gas hydrate slurry in a cylindrical compression chamber provided with a compression plunger capable of advancing and retreating in the cylindrical compression chamber in a direction of an axis of the compression chamber, and advancing the compression plunger to exert compression action for squeezing out water from the gas hydrate slurry to mold the gas hydrate pellet, wherein an advancing speed of the compression plunger is less than a value expressed by a length of the pellet before compression$\times 10^{-2}$ (m/min).

* * * * *

UNITED STATES PATENT AND TRADEMARK OFFICE

CERTIFICATE OF CORRECTION

PATENT NO. : 9,039,949 B2
APPLICATION NO. : 14/114728
DATED : May 26, 2015
INVENTOR(S) : Wataru Iwabuchi et al.

It is certified that error appears in the above-identified patent and that said Letters Patent is hereby corrected as shown below:

In the Claims:

In claim 1, at column 8, line 26: “shiny” should instead read --slurry--.

Signed and Sealed this
Twenty-fourth Day of November, 2015

Michelle K. Lee

Michelle K. Lee
*Director of the United States Patent and Trademark Office*